US006467946B1

(12) United States Patent
Gebrian

(10) Patent No.: US 6,467,946 B1
(45) Date of Patent: Oct. 22, 2002

(54) METHOD AND APPARATUS FOR MIXING LIQUID SAMPLES IN A CONTAINER USING ROTATING MAGNETIC FIELDS

(75) Inventor: Peter Louis Gebrian, Wilmington, DE (US)

(73) Assignee: Dade MicroScan Inc., Sacramento, CA (US)

( * ) Notice: Subject to any disclaimer, the term of this patent is extended or adjusted under 35 U.S.C. 154(b) by 0 days.

(21) Appl. No.: 09/841,468

(22) Filed: Apr. 24, 2001

(51) Int. Cl.[7] ..... B01F 13/08
(52) U.S. Cl. ..... 366/273
(58) Field of Search ..... 366/208, 209, 366/212, 218, 219, 273, 274; 416/3; 417/420; 464/29; 435/302.1; 266/234

(56) References Cited

U.S. PATENT DOCUMENTS

| | | | | |
|---|---|---|---|---|
| 2,844,363 | A | * | 7/1958 | Clark |
| 2,951,689 | A | * | 9/1960 | Asp et al. |
| 3,088,716 | A | * | 5/1963 | Stott |
| 3,356,346 | A | * | 12/1967 | Landsberger |
| 3,503,592 | A | * | 3/1970 | Taylor, Sr. et al. |
| 3,595,531 | A | * | 7/1971 | Williams et al. |
| 3,730,488 | A | * | 5/1973 | Gardner, Jr. |
| 3,749,369 | A | * | 7/1973 | Landsberger |
| 3,831,903 | A | * | 8/1974 | Harmel, Jr. |
| 3,997,272 | A | * | 12/1976 | George |
| 4,040,605 | A | * | 8/1977 | Towsend |
| 4,162,855 | A | | 7/1979 | Bender |
| 4,266,950 | A | * | 5/1981 | Makino et al. |
| 4,390,283 | A | * | 6/1983 | Meyer |
| 4,477,192 | A | * | 10/1984 | Bonney |
| 4,534,656 | A | | 8/1985 | De Bruyne |
| 4,653,519 | A | * | 3/1987 | Kanner |
| 4,665,736 | A | * | 5/1987 | Yokoyama et al. |
| 4,720,025 | A | * | 1/1988 | Tatevosian |
| 4,728,500 | A | | 3/1988 | Higo |
| 4,876,069 | A | * | 10/1989 | Jochimsen |
| 5,078,969 | A | | 1/1992 | Bacus |
| 5,272,092 | A | * | 12/1993 | Hamasaki et al. |
| 5,352,036 | A | * | 10/1994 | Haber et al. |
| 5,529,391 | A | * | 6/1996 | Kindman et al. |
| 5,547,280 | A | | 8/1996 | Wanninger |
| 5,578,201 | A | * | 11/1996 | Collier et al. |
| 5,586,823 | A | | 12/1996 | Carr |
| 5,961,213 | A | * | 10/1999 | Tsuyuki et al. |
| 6,033,377 | A | * | 3/2000 | Rasmussen et al. |
| 6,382,827 | B1 | * | 5/2002 | Gebrian ..... 366/274 |

FOREIGN PATENT DOCUMENTS

| | | | |
|---|---|---|---|
| DE | 3344754 | * | 6/1985 |
| GB | 2082929 | * | 3/1982 |
| GB | 2082930 | * | 3/1982 |
| JP | 63-185435 | * | 8/1988 |

* cited by examiner

*Primary Examiner*—Charles E. Cooley
(74) *Attorney, Agent, or Firm*—Leland K. Jordan

(57) ABSTRACT

Mixing a liquid solution in a container by rotating a pair of bar-shaped magnets in a coordinated pattern in which lines parallel to the axes of the bar-shaped magnets remain normal to one another, the magnets disposed in close proximity to and on opposite sides of the container a distance above the bottom of the container so that a magnetic mixing member is caused to rotate in the liquid about the same distance above the bottom of the container. Relative vertical movement of the magnets and the container generates a vortex-like mixing action throughout the container.

16 Claims, 10 Drawing Sheets

METHOD AND APPARATUS FOR MIXING LIQUID SAMPLES IN A CONTAINER USING ROTATING MAGNETIC FIELDS

FIELD OF THE INVENTION

The present invention relates to a method and apparatus for uniformly mixing liquid samples, reagents, or other solutions in a container. In particular, the present invention provides a method for rapidly and uniformly mixing a liquid by using a pair of magnetic field sources rotating near the sides of the container to generate a vortex mixing action within the liquid.

BACKGROUND OF THE INVENTION

Automated microbiology and clinical chemistry analyzers identify the presence of microorganisms and analytes in body fluids such as urine, blood serum, plasma, cerebrospinal fluid, sputum and the like. Automated microbiology and clinical chemistry analyzers improve productivity and enable the clinical laboratory to meet the workload resulting from high-test volume. Automated systems provide faster and more accurate results as well as valuable information to clinicians with regard to the types of antibiotics or medicines that can effectively treat patients diagnosed with infections or diseases. In a fully automated analyzer, many different processes are required to identify microorganisms or analytes and an effective type of antibiotic or medicine. Throughout these processes, patient liquid samples and samples in combination with various liquid reagents and antibiotics, are frequently required to be mixed to a high degree of uniformity producing a demand for high speed, low cost mixers that occupy a minimal amount of space.

Analyzers like those described above perform a variety of analytical processes upon microbiological liquid samples and in most of these, it is critical that a patient's biological sample, particularly when in a liquid state, be uniformly mixed with analytical reagents or diluent or other liquids or even re-hydrated compositions and presented to an analytical module in a uniformly mixed state. In a biochemical analyzer, other liquids like broth may need to be uniformly stirred before being used. Various methods have been implemented to provide a uniform sample solution mixture, including agitation, mixing, ball milling, etc.

One popular approach involves using a pipette to alternately aspirate and release a portion of liquid solution within a liquid container. Magnetic mixing, in which a vortex mixing action is introduced into a solution of liquid sample and liquid or non-dissolving reagents, herein called a sample liquid solution, has also been particularly useful in clinical and laboratory devices. Typically, such magnetic mixing involves rotating or revolving a magnetic field beneath the bottom of a container so as to cause a magnetically susceptible mixing member to rotate in a generally circular path in a plane inside the container at the bottom of the container. Thus, such magnetic mixers require that a magnetically susceptible mixing member be placed in close proximity, essentially in physical contact, with the bottom of the container.

Magnetic mixers that cause a magnetically susceptible mixing member to rotate or revolve at the bottom level or top level of liquid in a container are not useable in the instance of so-called "false-bottom" sample containers. False-bottom containers have the same general size as standard containers, but have an additional false bottom located at a predetermined distance above the physical bottom of the container. False-bottom containers are advantageously employed in several instances, for instance when it is desired to decrease the physical size of aspiration means which extract patient sample from a container. In such cases, the vertical travel required by the aspirator is decreased as the liquid sample level is found nearer the top of its container. Using false-bottom containers also makes it possible to handle smaller-than-normal liquid samples in containers that also have an extended surface for carrying bar-code indicia. In other instances and for various reasons, only a small volume of a patient's sample may be available and false-bottom containers makes it possible to transport a smaller-than-normal sample volume within an automated analyzer without having special handling devices adapted to operate on smaller-than-normal sample containers. Alternately, in the instance of magnetic vortex mixing, it may be desirable for reasons of mixing efficiency to have the source of mixing energy, the mixing member, located anywhere within the volume of a sample to be mixed as opposed to having the mixing member located at either the top or bottom of the sample container. Even further, it may be desirable for reasons of mixing efficiency for the source of rotational energy to be vertically moveable relative to the sample liquid during the mixing process as opposed to having the mixing member located in a stationary plane within the sample container.

U.S. Pat. No. 5,586,823 describes a magnetic stirrer comprising a bottle having a base and a stirrer bar of relatively low power magnetization lying on the bottle base. A permanent magnet of relatively high power is located beneath and close to the bottle base, and means for continuously rotating the external permanent magnet about an axis substantially normal to the bottle base. The rotating magnetic field causes the stirrer bar to continuously rotate within the liquid in a plane parallel to and above the bottle base.

U.S. Pat. No. 5,547,280 discloses a two-part housing magnetic stirrer having a lower drive and an upper part that forms a mounting surface for a sample container having a mixing magnet. The separating surface of the upper and lower parts are approximately horizontal in the working position. The upper part is made of glass and, when in its working position, is tightly pressed against an opposing surface of the lower part to provide a magnetic stirrer that is sealed against aggressive vapors.

U.S. Pat. No. 5,078,969 discloses a stirrer which is placed on a reaction vessel and used for staining biological specimens on microscope slides in a jar. The bottom wall of the jar is perforated and made of glass so that the magnetic flux passes through to couple a stirrer rod to a magnetic drive arm. The jar is seated on a platform with the magnetic-stirrer drive mounted and operable below the platform. The magnetic drive has a motor with magnetic drive arm like a permanent magnetic and a variable speed control device to control the angular velocity of the magnetic arm.

U.S. Pat. No. 4,728,500 discloses a stirrer comprising a magnetically permeable vessel containing at least one magnetic bead and a magnetic device having a spacer with a number of longitudinally positioned magnetic bars parallel to one another disposed thereon. The bars may be moved in a longitudinal direction beneath the vessel so as to produce an oscillating magnetic field causing the beads to undergo an elliptic motion.

U.S. Pat. No. 4,534,656 discloses a magnetic stirrer apparatus in which the stirrer is buoyant, and thereby floats on the surface of a liquid which is to be stirred. The stirrer is caused to be rotated, generally about the vertical axis of the flask, and is enabled to change its elevation, relative to the bottom of the flask, as the level of liquid in the flask is changed. The floating stirrer is restricted by a guide rod to rotational movement, and to vertical movement as the liquid level changes; a magnetic drive is provided to cause rotational movement of the stirrer, thereby to mix the liquid in the flask.

U.S. Pat. No. 4,162,855 discloses a magnetic rotor having a central hub which has a surface covered with an inherently high lubricity material and on which is mounted a radially extending magnetic impeller. The magnetic rotor is mounted in a central collar portion of a cage which has a number of frame members extending from the collar to prevent the rotating impeller from engaging the walls of the vessel. As the outward members maintain the cage in position within the vessel, the magnetic rotor is allowed to "float" relative to the cage and rotate freely, with extremely low frictional forces, relative to the vessel to agitate the substance therein.

Accordingly, from a study of the different magnetic mixers available in the prior art, there is an unmet need for an improved magnetic vortex mixer capable of magnetically mixing small volume liquid samples held within false-bottom containers. In addition, there is a need for a magnetic mixer which provides a uniform mixing action within liquid samples contained in false-bottom tubes held in a sample tube rack without removing the sample tubes from the rack so as to eliminate the need for time-consuming and spacious mechanisms to move the tube to a separate location for mixing. There is a further need for magnetic mixing method having increased efficiency by moving the mixing member along an axis of the sample container during the mixing process, as may be required for low viscosity liquid samples.

SUMMARY OF THE INVENTION

Many of these disadvantages to the prior art are overcome by using the apparatus and/or methods of this invention. This invention provides a method for mixing a liquid solution contained in a container by causing a freely disposed, magnetically susceptible mixing member to rotate or revolve in a generally circular pattern in a plane above the physical bottom of the container. The magnetic mixing member may have a spherical or oblong shape and is caused to rotate within the solution by revolving a pair of magnetic field sources external to the liquid container in a plane above the physical bottom of the container in a generally circular pattern. Rotation of the magnetic field sources is controlled so that the combined magnetic fields acting upon the magnetic mixing member cause it to rotate and generate a mixing motion within the liquid solution. In an exemplary embodiment, the magnetic field sources are diametrically opposed along the sides of and are in close proximity to a false bottom of a liquid sample container and are rotated in a coordinated motion. In an alternate embodiment, the magnetic field sources are rotated at diametrically opposed positions along a liquid sample container and the liquid sample container is moved upwards or downwards relative to the magnetic field sources.

In any of these embodiments, multiple liquid solutions held in liquid containers supported in a rack may be simultaneously mixed by moving the rack through the revolving magnetic fields while the containers remain within the rack. In an exemplary embodiment, the small magnetic mixing member is shaped like a spherical ball and may be automatically dispensed either at time of manufacture of the liquid sample container or loaded on-board the instrument into a liquid solution container easily. Such a spherical mixing member may be produced in large quantities at very low cost so that it may be discarded after a single use in contrast to prior art stirring members that are typically expensive plastic-coated permanent magnets and are therefore repeatedly used, increasing risk of contamination.

BRIEF DESCRIPTION OF THE DRAWINGS

The invention will be more fully understood from the following detailed description thereof taken in connection with the accompanying drawings which form a part of this application and in which.

DETAILED DESCRIPTION OF THE INVENTION

Figure 1:
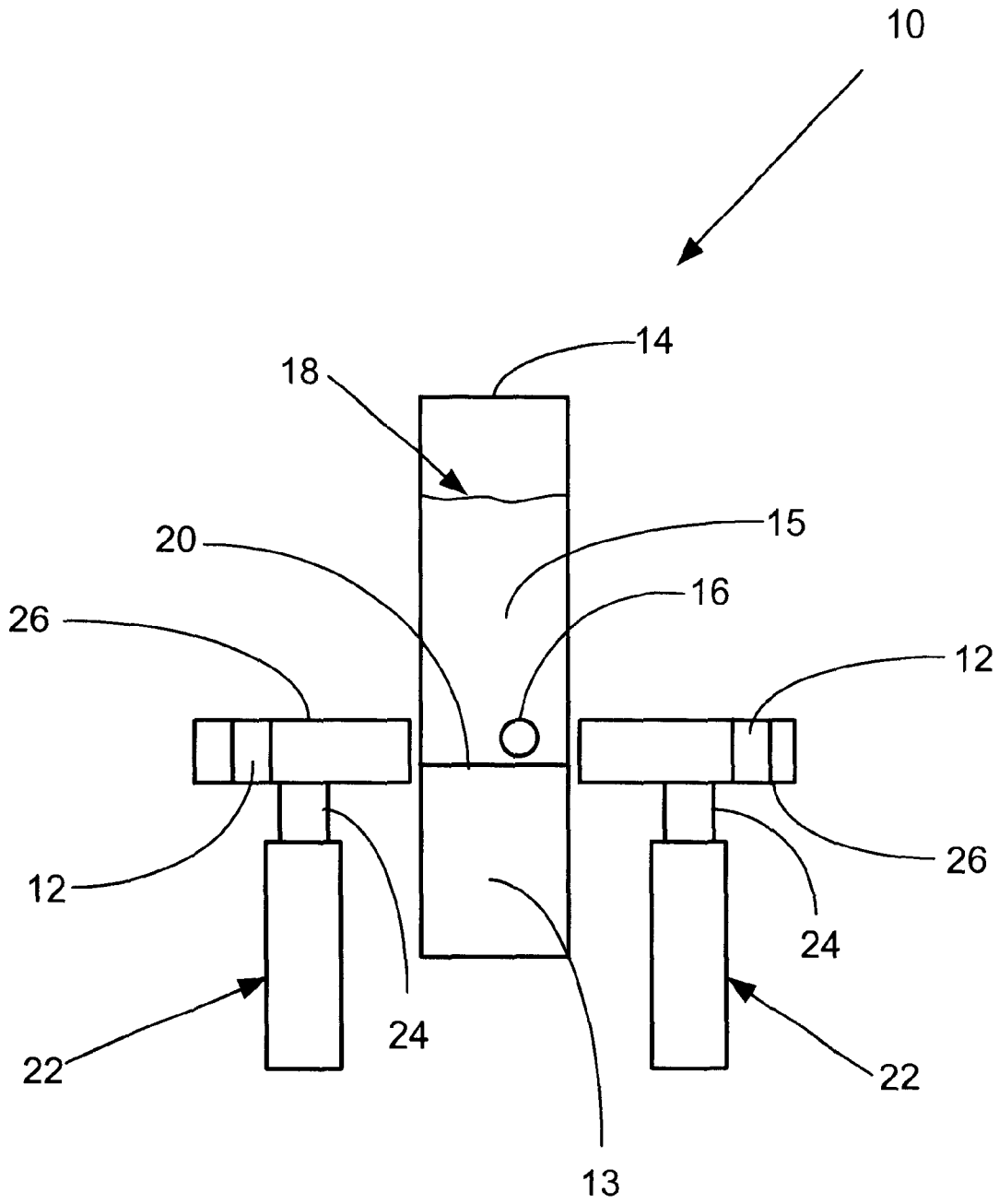
FIG. 1 is a schematic elevation view of a magnetic mixing apparatus that may be used to advantage in practicing the present invention with false bottom sample containers.

FIG. 1 shows the elements of a magnetic mixing apparatus 10 comprising a pair of magnetic field sources 12 disposed at diametrically opposite locations alongside a liquid container 14 and having sufficient magnetic strength so that the combined non-uniform magnetic forces acting on a mixing member 16 produced by revolving the magnetic field sources 12 generate an effective mixing motion within a liquid sample 18 within the liquid container 14. In a highly effective embodiment of the present invention, the magnetic field sources 12 are bar-shaped magnets 12 having opposed north-pole and south-pole ends and are diametrically opposed at positions along the side of container 14 that correspond to the location of a false bottom 20 within container 14. Liquid container 14 comprises a lower empty portion 13 containing air and separated and sealed from an upper portion 15 containing liquid sample 18. For convenience, a pair of motors 22 provide rotation to motor shafts 24 having disks 26, each encasing a bar-shaped magnet 12 with its cylindrical axes intersecting north-pole end N and an opposed south-pole end S.

Figure 2:
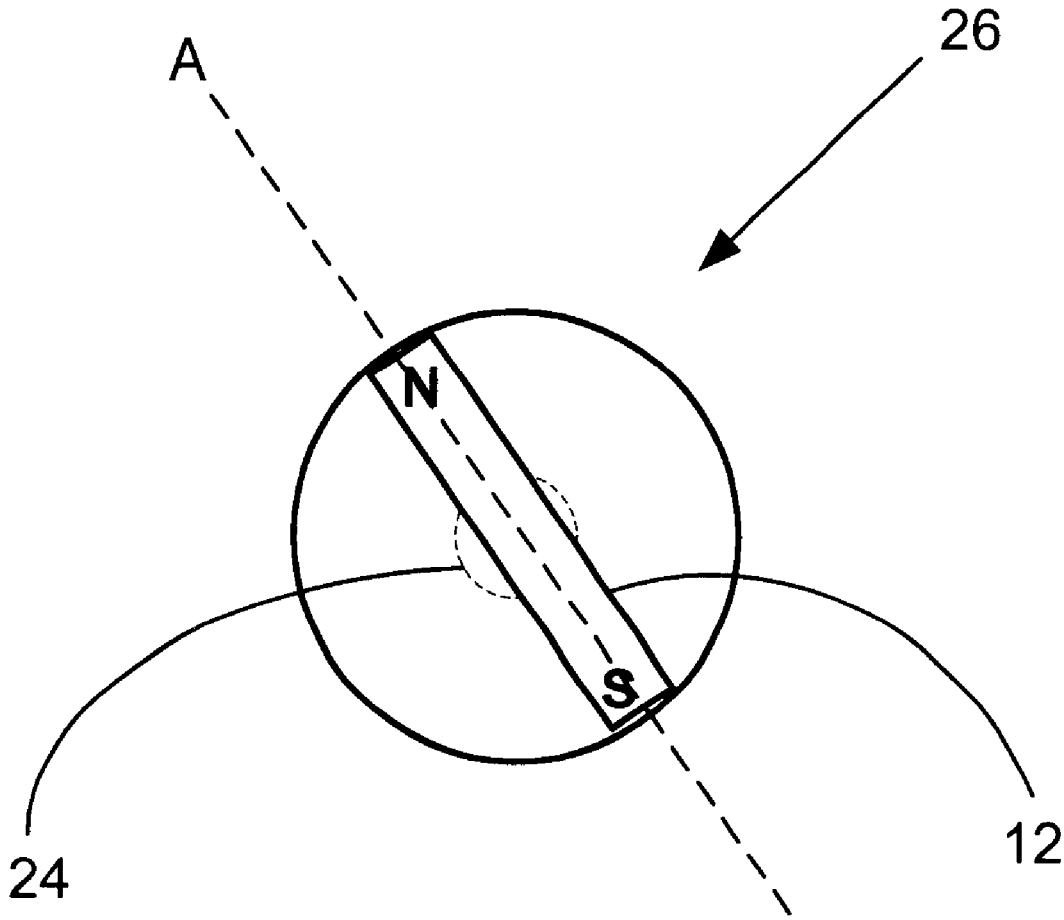
FIG. 2 is a top plan view of a mixing disk useful in practicing the invention of FIG. 1.

FIG. 2 is a top plan view of such a disk 26 encasing the bar-shaped magnets 12 showing the axis A of such a bar-shaped magnet 12. Rotation of disks 26 by motor shafts 24 in a coordinated pattern described hereinafter produces a combined rotating magnetic field acting on mixing member 16 which causes mixing member 16 to rotate in a generally circular pattern within liquid 18 thereby generating a vortex-like mixing motion of liquid 18. Additionally, the present invention may be practiced by reversing or alternating the direction of rotational motion of the magnetic field sources 12 during mixing to induce a shear-agitation mixing motion of liquid 18.

Figure 7:
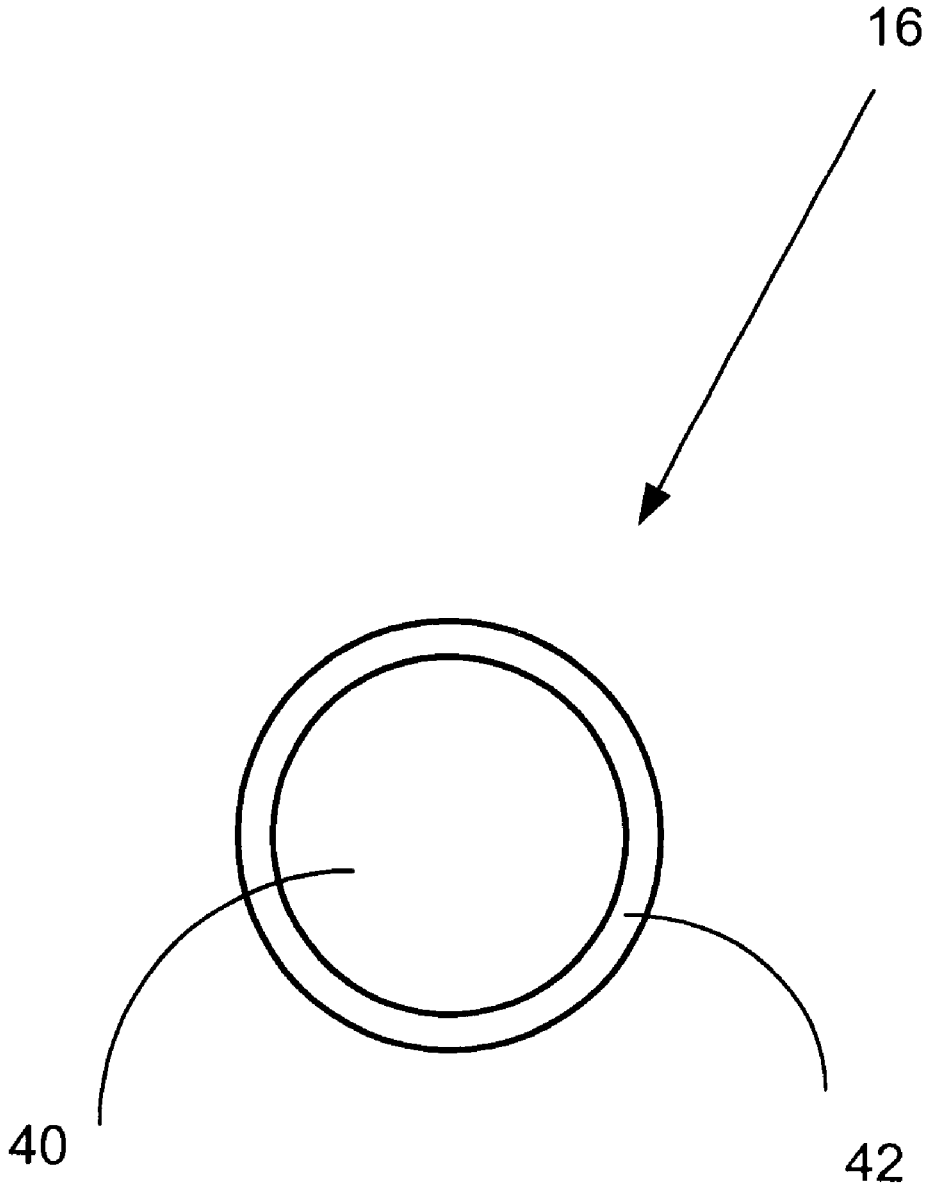

Mixing member 16 may be formed, for example, like a bar or ball 16 of ferromagnetic or semi-ferromagnetic material (see FIG. 7). Hereinafter the term ferromagnetic is intended to mean a substance having a sufficiently high magnetic permeability to be positionally affected by an orbiting or rotating magnetic field. Mixing member 16 is sized and has a sufficiently high magnetic permeability so that the magnetic field forces generated by magnetic field sources 12 are greater than forces of gravity acting upon mixing member 16. The term magnetic is likewise intended to mean a substance that is independently capable of generating a magnetic field. Liquid container 14 is of a non-magnetic material and may be supported in an upper section of a mixing stand (not shown for clarity purposes), the mixing stand also having with lower section designed to encase motors 22.

It has been discovered that a highly effective mixing or agitation action occurs in liquid sample 18 using the above described combination of revolving bar-shaped mixing magnets 12 and mixing member 16 when the bar-shaped magnets 12 are revolved in a same first direction at diametrically opposed locations across liquid container 14 in a pattern that causes mixing member 16 to revolve in a second direction opposite to the first direction. It has been found that the most effective embodiments of the present invention comprise controlling the relative rotation of bar-shaped magnets 12 so that the separate magnetic fields of the two separate bar-shaped magnets 12 are 90 degrees out of phase with one another. Consequently, the separate magnetic fields interact to produce a single magnetic field that rotates in a direction opposite to the direction of rotation of the bar-shaped magnets 12.

FIGS. 3A–K are schematic top plan views of mixer 10 and illustrate an embodiment of the present invention wherein two bar-shaped mixing magnets 12 encased in disks 26 are rotated by motor shafts 24 in a clockwise direction so that cylindrical axes of the bar-shaped magnets remain normal to one another. Thus, the magnetic fields of the two separate bar-shaped magnets 12 are 90 degrees out of phase with one another, as described above. Such a synchronized rotation produces a single magnetic field that rotates in a direction opposite to the direction of rotation of the bar-shaped magnets 12, thereby causing mixing member 16 to rotate in a counter-clockwise direction within liquid sample 18 contained within liquid container 14. As shown in FIG. 1, disks 26 are located at a vertical location along the side of container 14 that corresponds to the location of false bottom 20 within container 14 so that an effective vortex-like mixing action takes place in liquid sample 18 even though lower portion 13 contains air and is separated from upper portion 15 containing liquid sample 18. FIGS. 3A–K are a "slow-motion" description of the mixing process of the present invention.

Figure 3A:
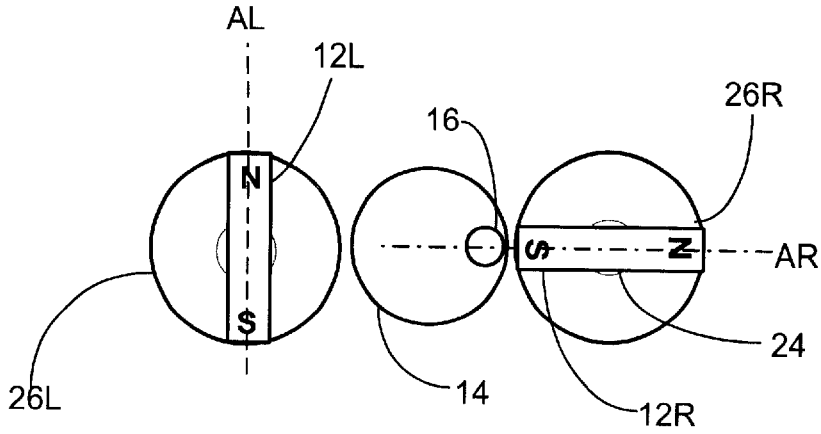
FIGS. 3A–3K are schematic illustrations of coordinated motion of a pair of magnetic field sources revolving in a plane above the physical bottom of a container as taught by the present invention.

FIG. 3A shows two disks 26L and 26R comprising bar-shaped mixing magnets 12L and 12R and being diametrically disposed on opposite left-hand and right-hand sides, respectively, of a liquid container 14 containing sample 18 to be mixed. Disks 26L and 26R are essentially identical but are assigned different numbers in FIG. 3A–K for purposes of describing the present invention. In FIG. 3A, disk 26R is shown in a initial stationary position so that, for example, mixing member 16 is aligned with the south-pole end S of mixing magnet 12R along the cylindrical axis AR of magnet 12R. In this initial mixing positioning, disk 26L is oriented so that cylindrical axis AL of mixing magnet 12L is normal to cylindrical axis AR. Obviously the relative positions of north-pole end N and the south-pole end S could be reversed in both magnets 12L and 12R and yield an identical mixing process. This 90-degree phase difference between mixing magnet 12R and mixing magnet 12L is maintained throughout the mixing process of the present invention in order to produce a net magnetic field that rotates in a direction opposite to the direction of rotation of the bar-shaped magnets 12R and 12L.

Figure 3B:
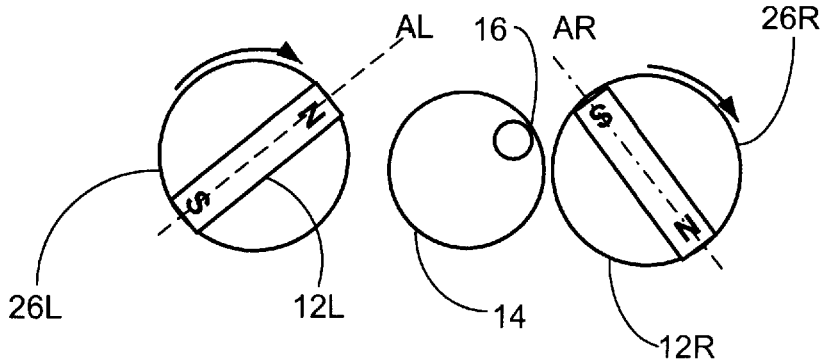

FIG. 3B illustrates a first mixing stage subsequent to the initial position of FIG. 3A whereat both disks 26L and 26R have been rotated clockwise about 45 degrees. At this position, a net magnetic field different from that of FIG. 3A results from the changed positions of mixing magnets 12L and 12R. In this first mixing stage, mixing member 16 is caused to revolve also about 45 degrees counter-clockwise as a result of the changed positions of mixing magnets 12L and 12R. Because of the closest proximity to magnet 12R in the initial position of FIG. 3A, mixing member 16 "chases" the south pole end S of magnet 12R as it provides the strongest nearby magnetic field. Throughout the mixing process, mixing member 16 moves throughout the liquid to be mixed as the mixing member 16 is caused to move in a pattern that minimizes its physical distance to the nearest magnetic field. As described previously, it has been discovered that a highly effective mixing action may be generated within solution 18 by rotating mixing magnets 12L and 12R so that dashed-line AL drawn through the cylindrical axis of mixing magnet 12L remains normal to the dashed-line line AR drawn through the cylindrical axis of mixing magnet 12R.

Figure 3C:
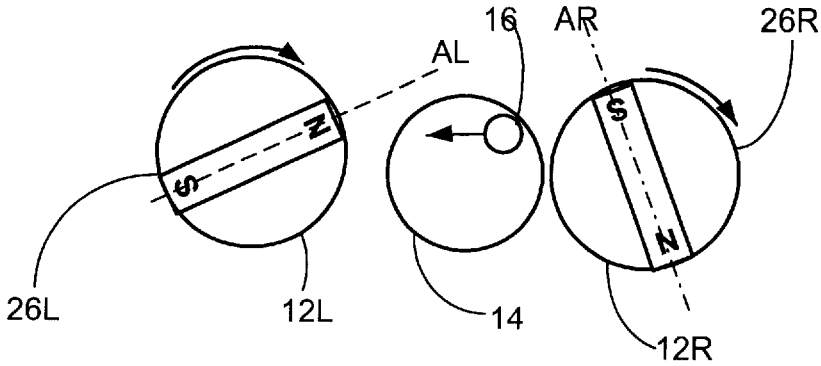

FIG. 3C illustrates a second mixing stage subsequent to the first mixing stage of FIG. 3B whereat both disks 26L and 26R have been rotated clockwise a total of about 55 degrees. At this position, a net magnetic field different from that of FIG. 3B results from the changed positions of mixing magnets 12L and 12R. In this second mixing stage, mixing member 16 is roughly equidistant from magnetic pole N of magnet 12L and magnetic pole S of magnet 12R and as disks 26 encasing the bar-shaped mixing magnets 12 are rotated an additional amount in a clockwise direction, mixing magnet 12L exerts a greater attraction on mixing member 16 than does mixing magnet 12R so that mixing member 16 travels towards magnet 12L in a path that tends to be more linear than circular. This situation occurs twice during each 360 revolution of the mixing member 16 along its generally circular mixing path.

Figure 3D:
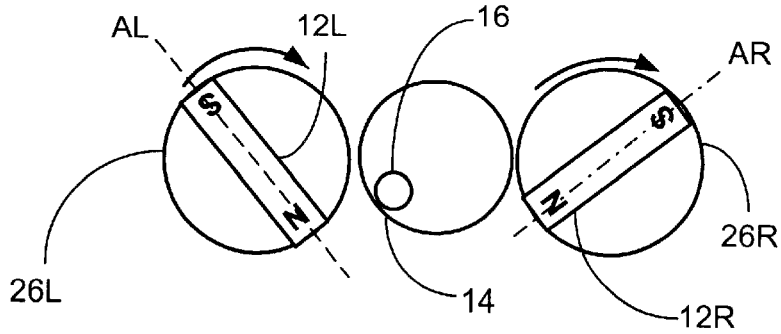
Figure 3E:
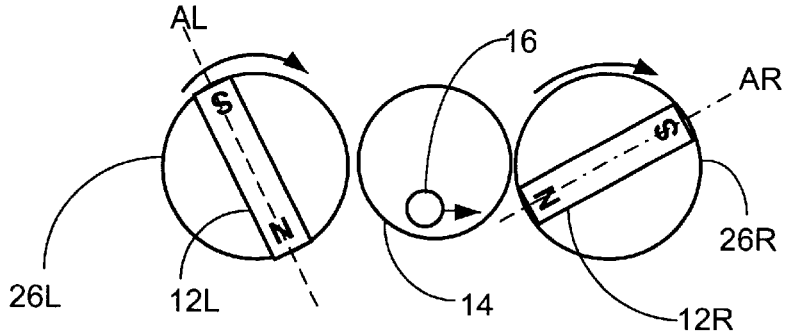
Figure 3F:
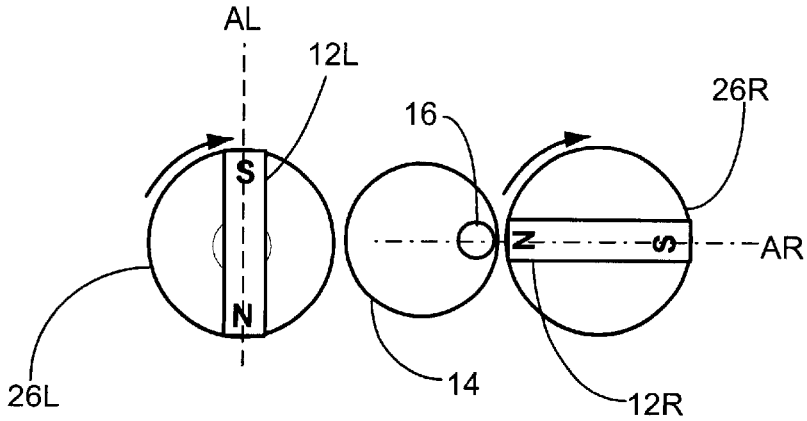
Figure 3G:
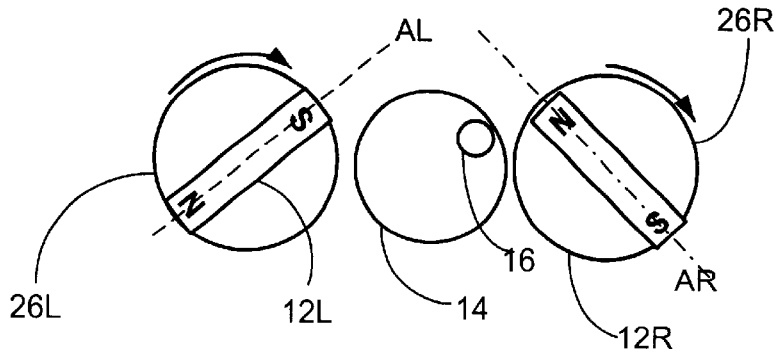
Figure 3H:
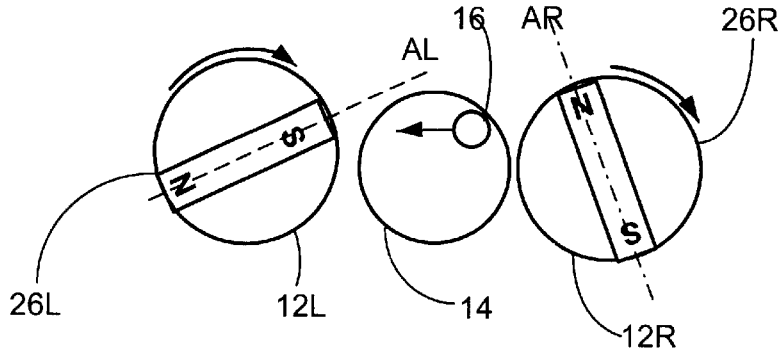
Figure 3I:
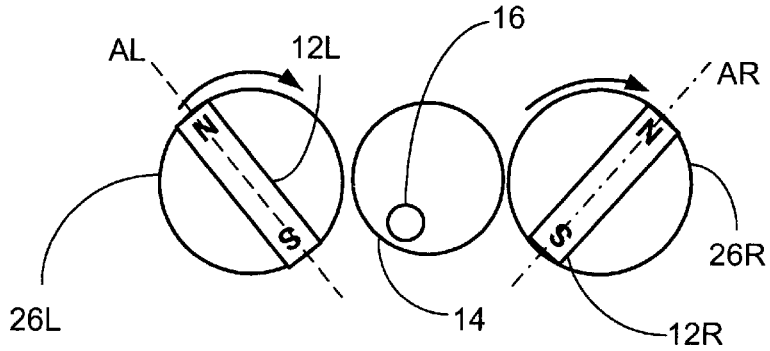
Figure 3J:
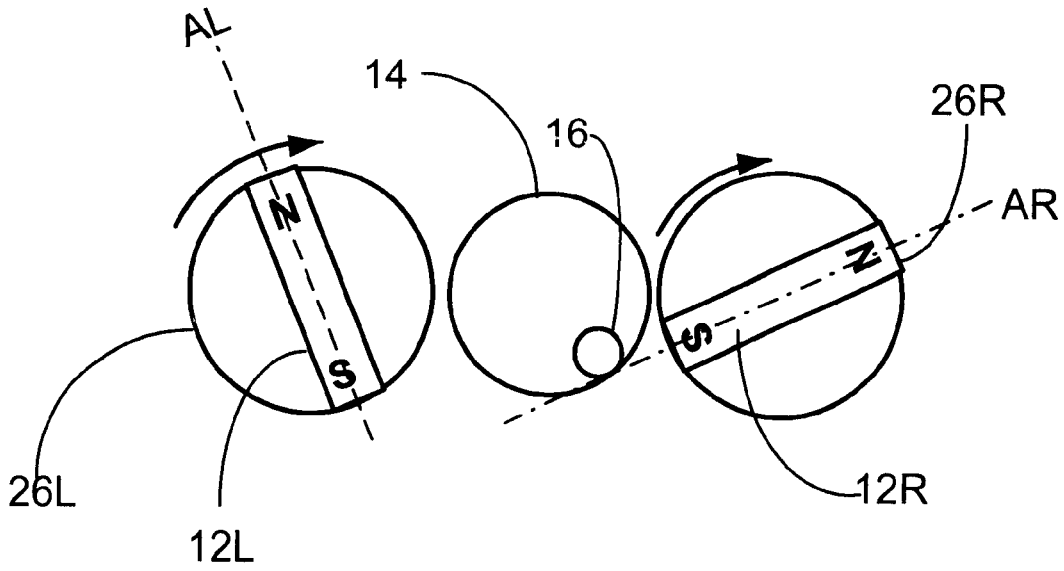
Figure 3K:
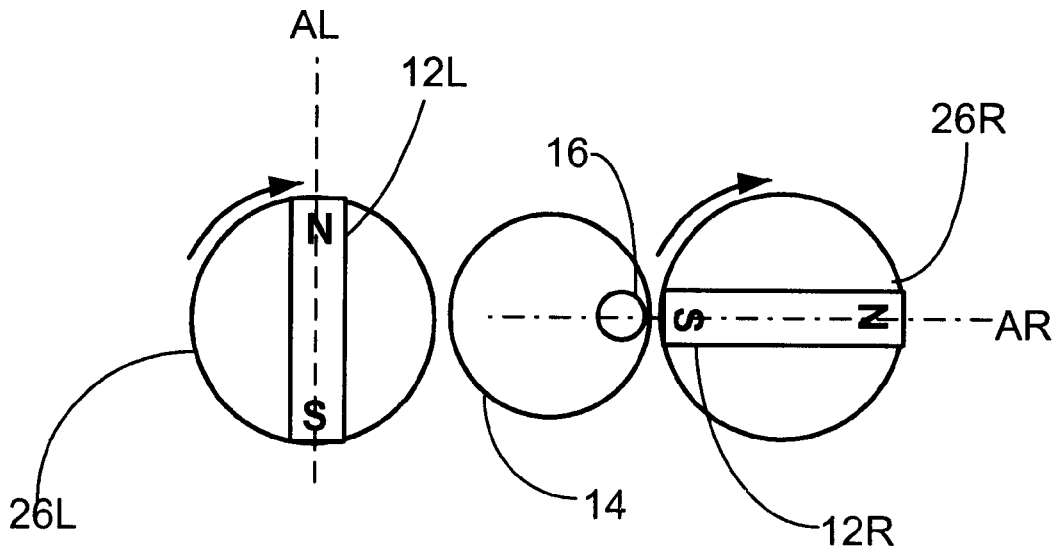

FIGS. 3D–F illustrate a series of mixing stages subsequent to the second mixing stage of FIG. 3C whereat both disks 26L and 26R have been rotated clockwise a total of about 180 degrees from starting position depicted in FIG. 3A. In each of these stages, a net magnetic field different from that of a prior stage results from the changed positions of mixing magnets 12L and 12R. During these stages, mixing member 16 is caused to revolve about 360 degrees counter-clockwise as a result of the 180 degree clockwise rotation of mixing magnets 12L and 12R. Throughout the mixing process, disks 26 encasing the bar-shaped mixing magnets 12 continue to rotate in a pattern controlled so that cylindrical axis AL of mixing magnet 12L remains normal to the cylindrical axis AR of mixing magnet 12R. At the mixing stage illustrated by FIG. 3F, disk 26L, disk 26R and magnetic mixing member 16 are in a magnetically equivalent position and orientation as that of FIG. 3A. Continuous operation of motors 22 causes motor shafts 24 to continuously rotate in a clockwise direction so that disks 26L and 26R also continuously rotate clockwise, as shown in FIGS. G–H–I–J–K, thereby repeating the counterclockwise rotation of mixing member 16 depicted by FIGS. 3A–F. Because of the viscous shear action generated within liquid 18 by the rotational movement of mixing member 16, a vortex-like mixing action is created within liquid 18. The present invention is thus seen to cause freely disposed, magnetically susceptible mixing member 16 to oscillate in a generally circular pattern anywhere within the volume of a sample to be mixed as opposed to having the mixing member located at either the top or bottom of the sample container.

Figure 4:
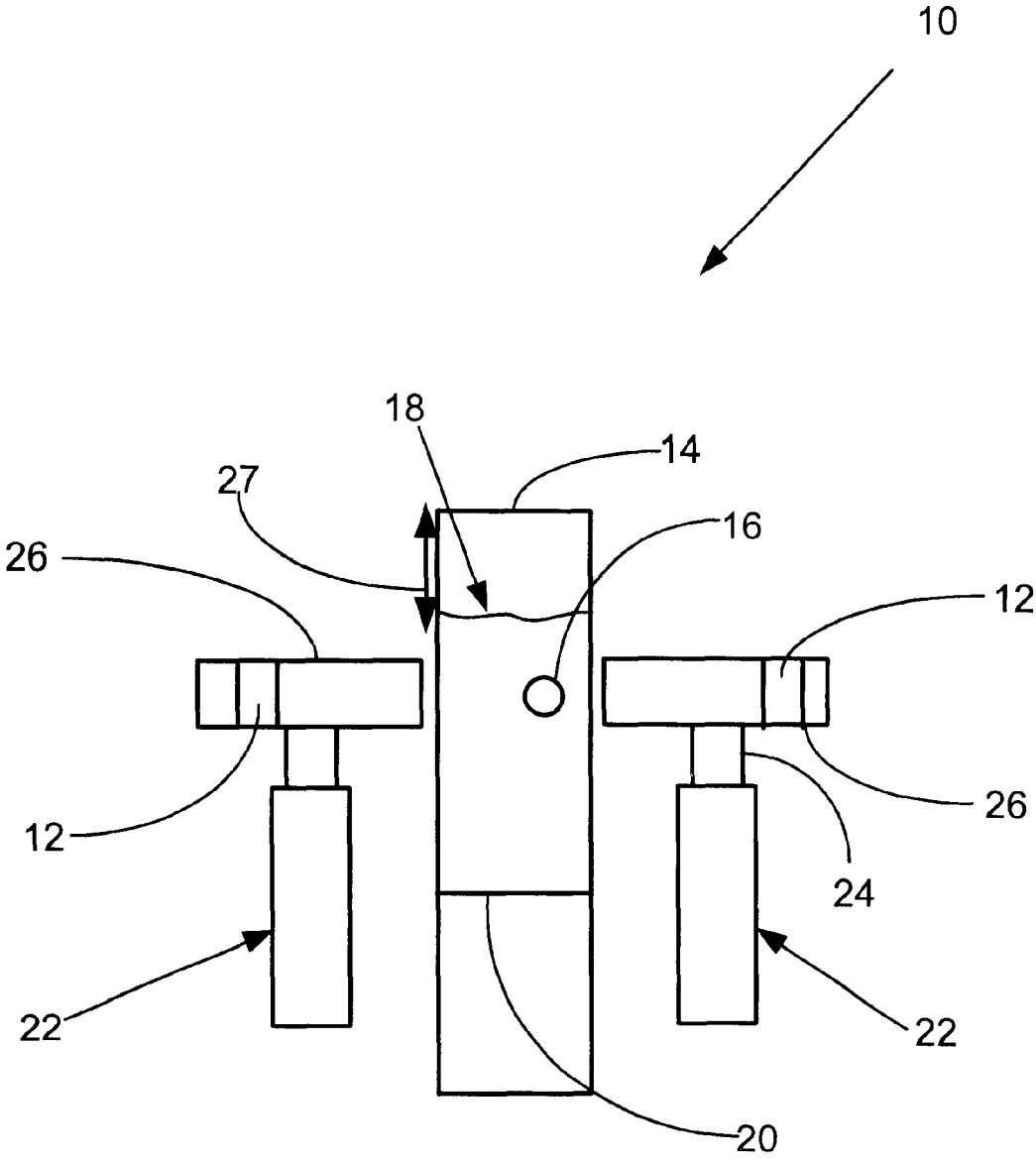
FIG. 4 is a schematic elevation view of a alternate exemplary magnetic mixing apparatus in which magnetic field sources are rotated at opposite locations of a liquid sample container having a false bottom and the container is moveable between the rotating magnetic field sources as taught by the present invention.

FIG. 4 shows the elements of an alternate embodiment of magnetic mixing apparatus 10 in which container 14 is moved vertically between the revolving mixing magnets 12 so that the rotating magnetic field acting on mixing member 16 causes mixing member 16 to rotate at a number of different heights or planes within liquid 18.

Equivalently, this alternate embodiment may be practiced by holding the container 14 stationary and moving motors 22 provided to rotate mixing magnets 12 as described before vertically along the sides of container 14. Motion of container 14 "upward and/or downward" between disks 26L and 26R comprising mixing magnets 12L and 12R is indicated by bi-directional arrow 27 in FIG. 4. This alternate embodiment of the present invention is seen to provide a means for generating a vortex-like mixing action throughout the entirety of the volume of liquid 18 in distinction to constraining the rotation of mixing member 16 to be proximate false bottom 20 of container 14.

Figure 5:
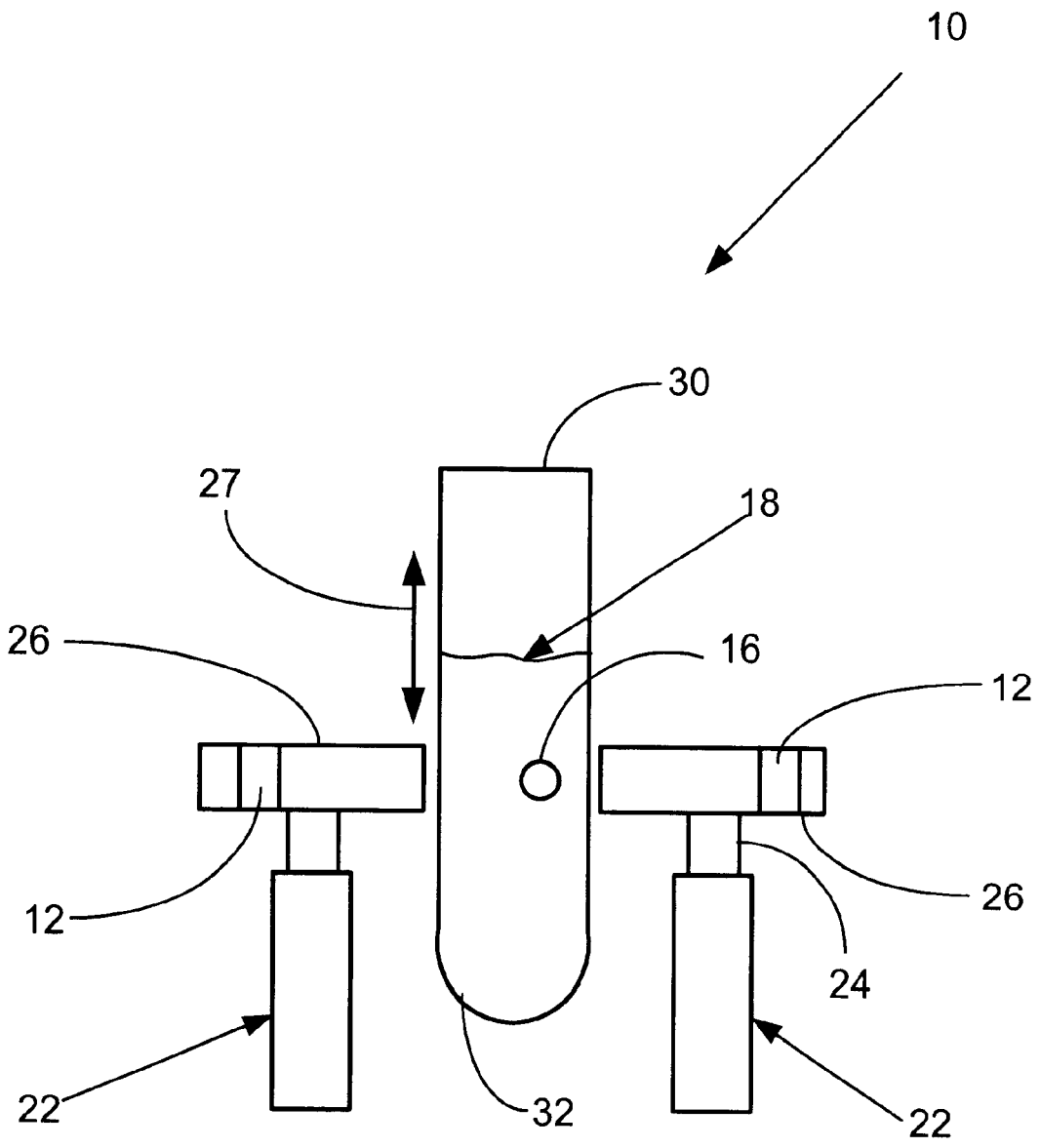
FIG. 5 is a schematic elevation view of another exemplary magnetic mixing apparatus in which magnetic field sources are rotated at opposite locations of a conventional liquid sample container and the container is moveable between the rotating magnetic field sources as taught by the present invention.

In an embodiment similar to FIG. 4, as depicted in FIG. 5, a conventional container 30 not having a false bottom but being filled with liquid 18 to be mixed may moved vertically between the revolving mixing magnets 12 so that the rotating magnetic field acting on mixing member 16 causes mixing member 16 to rotate at a number of different heights or planes within liquid 18, thereby mixing liquid 18 throughout its entirety. Such an embodiment may be particularly useful in the event that liquid 18 is of such low viscosity that a vortex-like mixing action generated by mixing member 16 only proximate the bottom 32 of container 30 would be ineffective or time-wise inefficient in generating a mixing action throughout the entirety of liquid 18. The embodiment illustrated in FIG. 5 is also useful in instances wherein it is undesirable to place a conventional magnetic stirring apparatus beneath a conventional container as is usual practice in laboratory mixing devices. Such a situation may arise, for example, whenever it is important to minimize physical sizes of devices in automated laboratory analyzers.

In all embodiments, mixing member 16 is preferably formed from a ferromagnetic or semi-ferromagnetic material and simple rotation of mixing magnets 12 by motors 22 produces corresponding revolving magnetic field forces upon mixing member 16 in container 14. Magnets 12 may comprise, for example, permanent magnets formed of neodymium-iron-boron (NdFeB) or other similar materials. Successful mixing of a low viscosity, liquid solution has been accomplished in about ½ second using a 5000 rpm motor 22, from Maxon Motor Co., Fall River, Mass., with ¼ inch diameter×¾ inch long mixing magnets 12 having field strength 4000 gauss located diametrically across from and at a distance of about 1/16 inch from the exterior of container 14.

Figure 6A:
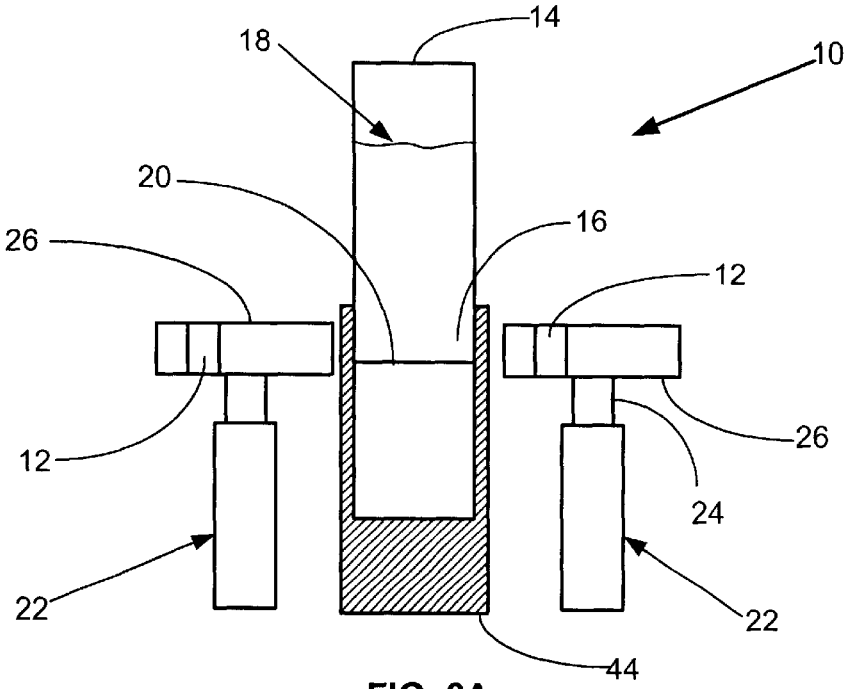
FIGS. 6A and 6B are schematic front and side elevation views of a magnetic mixing apparatus that may be used to mix a number of liquid solutions held in liquid sample containers without removing the containers from a support rack when practicing the present invention; and, FIG. 7 is a cross-section view of a mixing member that may be employed to advantage in the present invention.
Figure 6B:
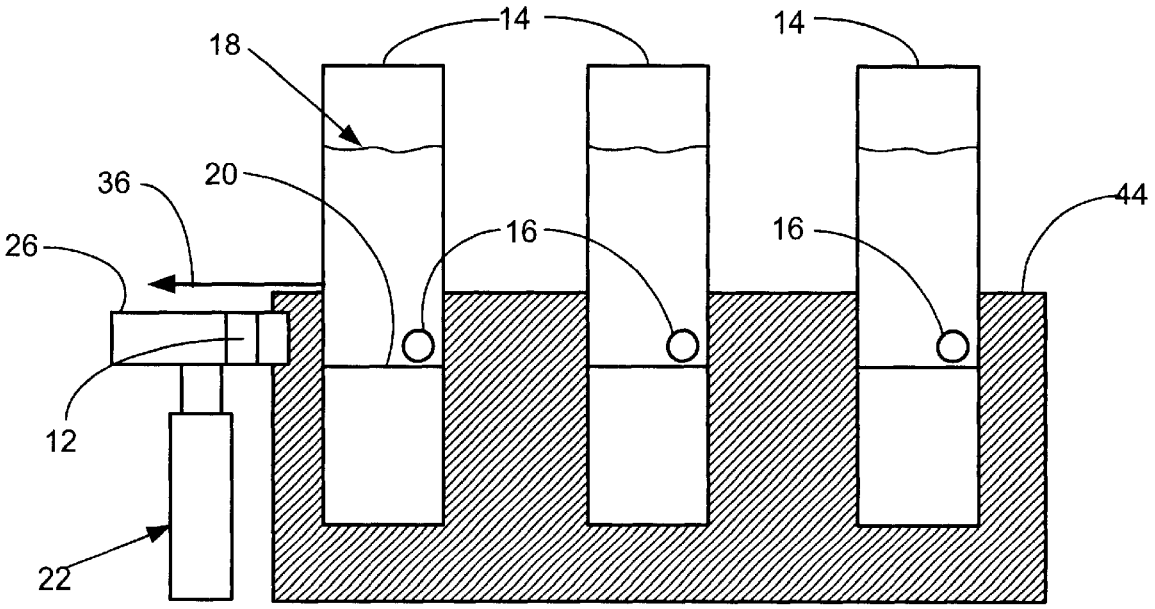

In another exemplary embodiment of magnetic mixing apparatus 10, a number of liquid containers 14 may be placed in a multiple-tube mixer block 44, as seen in FIG. 6A and 6B adapted to accommodate a number of tube-like liquid solution containers 14 in a linear array. Block 44 is transported in the direction shown by arrow 36 proximate the revolving magnetic field sources 12 so that the false bottoms 20 of the containers 14 each having mixing members 16 therein are positioned nearby to the revolving mixing magnets 12. In this instance, the mixer block 44 may be transported between the revolving mixing magnets 12 and the liquid solutions 18 within liquid containers 14 are mixed as the individual liquid containers 14 are positioned proximate thereto. In such an embodiment, the necessity for removing individual liquid containers 14 from block 44, as is the conventional practice within analytical laboratories, to a separate location is eliminated, thereby saving operating space and the expense of additional automated mechanisms. In comparison with FIG. 5 conventional tubes 30 may be substituted for false-bottom tubes 14 and disks 26 are positioned proximate the bottom 32 of tubes 30 so that magnetic mixing apparatus 10 of the present invention may also be useful in mixing liquids contained within numbers of conventional tubes.

FIG. 7 is an exemplary illustration of a ball-like mixing member 16 comprising an inner core 40 of ferromagnetic or semi-ferromagnetic material like an iron alloy and may be optionally coated with a thin layer 42 of protective, waterproof material like plastic, paint, epoxy, and the like. Such a ball-like mixing member 16 is very low in cost, typically less than 1 cent, and may be obtained from sources like the Epworth Mill, South Hoover, Mich., as a SAE-52100 Chrome Alloy Spherical Grinding Ball. Various plastic layers 42 like SURLYN™ or TEFLON™ plastics, polyethylene, or parylene plastics may be coated over the surface of mixing member 16 at a thickness of about 25 microns for the purpose of avoiding contamination (rust, iron oxide, etc.) and thereby maintaining the integrity of a liquid solution. Such coating services are available from, for example, PCS, Katy, Tex. In use, a number of these mixing members 16 may be supplied in a straw-like magazine and automatically dispensed into the liquid container 14 using any one of a number of conventional dispensers. Alternately, the mixing members 16 may be pre-disposed within the liquid container 14 before presentation to the magnetic mixing apparatus 10 and a number of liquid containers 14 may be supported in a conventional tube rack so that the liquid solution in the liquid container 14 may be uniformly mixed without removing the liquid containers 14 from the rack.

In an operative example of the present method for mixing a liquid solution using magnetic mixing apparatus 10 by placing a small, spherically shaped magnetic mixing member 16 within the liquid solution and revolving a magnetic field at high speed in a circular pattern at close proximity to the liquid container 14, a liquid solution 18 of water and red food dye was placed in a false-bottomed tube 14 having a diameter about 0.6 inches. A magnetic mixing member 16 formed of 52100 chrome alloy having a diameter within the range 2–6 mm was added to the solution within liquid container 14 like that shown in FIG. 1. Two bar-shaped mixing magnets 12 of size about ¼-inch by ¾-inch were attached to a pair of motor shafts and the motor supported so that the mixing magnets 12 were about 1/16-inch from the side of the liquid container 14. The motor was rotated for about ½-second at 5000 rpm and the distribution of dye within the solution was observed to be thoroughly and uniformly distributed.

It is to be understood that the embodiments of the invention disclosed herein are illustrative of the principles of the invention and that other modifications may be employed which are still within the scope of the invention. For example, obvious variants of the invention include using 2 separate small magnets to emulate the bar magnet, or replacing the permanent magnetic field with an circular electromagnetic field source and varying the time-intensity pattern of power supplied thereto, employing a non-spherical mixing member, eliminating the mixer block and placing the revolving magnetic field proximate to a tube in a rack, etc. Accordingly, the present invention is not limited to those embodiments precisely shown and described in the specification but only by the following claims.

What is claimed is:

1. A method for mixing a liquid solution contained in a container having a false bottom, the method comprising:

placing a ferromagnetic mixing member within the liquid solution contained in the container; and, rotating a pair of magnetic fields in a circular pattern in close proximity to the container near the location of the false bottom, wherein rotating the pair of magnetic fields comprises rotating a pair of magnets in a coordinated pattern in which lines parallel to the axes of the magnets remain normal to one another, so that magnetic forces acting upon the mixing member cause it to revolve thereby generating a mixing motion within the liquid solution.

2. The method of claim 1 wherein the pair of magnetic fields are rotated in close proximity to opposite sides of the container.

3. The method of claim 1 wherein the magnets comprises bar-shaped permanent or semi-permanent magnets.

4. The method of claim 1 wherein rotating the magnetic fields comprises rotating a pair of disks containing said magnets in a coordinated pattern in which the magnetic fields of the two separate magnets are 90 degrees out of phase with one another.

5. The method of claim 1 wherein the mixing member is spherical.

6. The method of claim 1 wherein the mixing member is made of an iron alloy and has a diameter in the range 2–6 mm.

7. The method of claim 1 wherein the mixing member has a protective coating to prevent contamination having thickness about 25 microns.

8. The method of claim 7 wherein the protective coating comprises a material selected from the group consisting of parylene, SURLYN™ and TEFLON™ plastics.

9. The method of claim 1 wherein the liquid container is supported within a rack and the rack is moved through the rotating magnetic fields.

10. A method for mixing a liquid solution contained in a container, the method comprising:

placing a ferromagnetic mixing member within the liquid solution contained in the container;

rotating a pair of magnetic fields in a circular pattern in close proximity to the container; and, moving the container vertically relative to the magnetic fields so that magnetic forces acting upon the mixing member cause it to revolve thereby generating a mixing motion throughout the entirety of the liquid solution.

11. The method of claim 10 for mixing a liquid solution contained in a container wherein rotating the pair of magnetic fields comprises rotating a pair of bar-shaped magnets in a coordinated pattern in which lines parallel to the axes of the bar-shaped magnets remain normal to one another.

12. The method of claim 10 wherein the magnetic fields are rotated in close proximity to opposite sides of the container.

13. The method of claim 10 wherein the ferromagnetic mixing member is spherical.

14. An apparatus for mixing a liquid solution within a liquid container, the apparatus comprising:

a liquid container having a false bottom;

a spherical ferromagnetic mixing member within the liquid in the container;

a pair of magnetic field sources positioned at opposite sides of the container proximate the false bottom; and, means for rotating the magnetic field sources in circular patterns in close proximity to the liquid container, wherein the means for rotating the magnetic field sources comprise rotating a pair of bar-shaped magnets in a coordinated pattern in which lines parallel to the axes of the bar-shaped magnets remain normal to one another, so that magnetic forces acting upon the magnetic mixing member cause it to rotate, thereby generating a mixing motion within the liquid solution.

15. The apparatus of claim 14 wherein the magnetic field sources are rotated in close proximity to the sides of the liquid container.

16. The apparatus of claim 14 for mixing a liquid sample solution within a liquid container wherein rotating the magnetic field sources comprises rotating a motor shaft having said magnetic field sources attached thereto.

* * * * *